United States Patent [19]

Kirkwood

[11] 4,063,714

[45] Dec. 20, 1977

[54] FENCE FORMED FROM PREFABRICATED SECTIONS

[75] Inventor: Robert E. Kirkwood, Sacramento, Calif.

[73] Assignee: The Raymond Lee Organization, Inc., New York, N.Y.

[21] Appl. No.: 685,546

[22] Filed: May 12, 1976

[51] Int. Cl.[2] ..... E04H 17/16
[52] U.S. Cl. ..... 256/24
[58] Field of Search ..... 256/24, 73, 19

[56] References Cited

U.S. PATENT DOCUMENTS

| | | | |
|---|---|---|---|
| 3,037,593 | 6/1962 | Webster | 256/24 |
| 3,411,753 | 11/1968 | Wood | 256/24 |

*Primary Examiner*—Werner H. Schroeder
*Assistant Examiner*—Doris L. Troutman
*Attorney, Agent, or Firm*—Howard I. Podell

[57] ABSTRACT

A fence which may be formed from prefabricated sections that readily fit together. The fence includes vertical members, each fitted with clips to fasten to horizontal spacers, a pair of horizontal spacers of a U-shaped section and a horizontal spacer of an H-section, together with flat panels that fit into the recesses of the U-shape and H-shape spacers.

4 Claims, 3 Drawing Figures

FENCE FORMED FROM PREFABRICATED SECTIONS

SUMMARY OF THE INVENTION

My invention is a fence which may be formed from prefabricated sections that readily fit together. The fence includes vertical members, each fitted with clips to fasten to horizontal spacers, a pair of horizontal spacers of a U-shaped section and a horizontal spacer of an H-section, together with flat panels that fit into the recesses of the U-shape and H-shape spacers.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
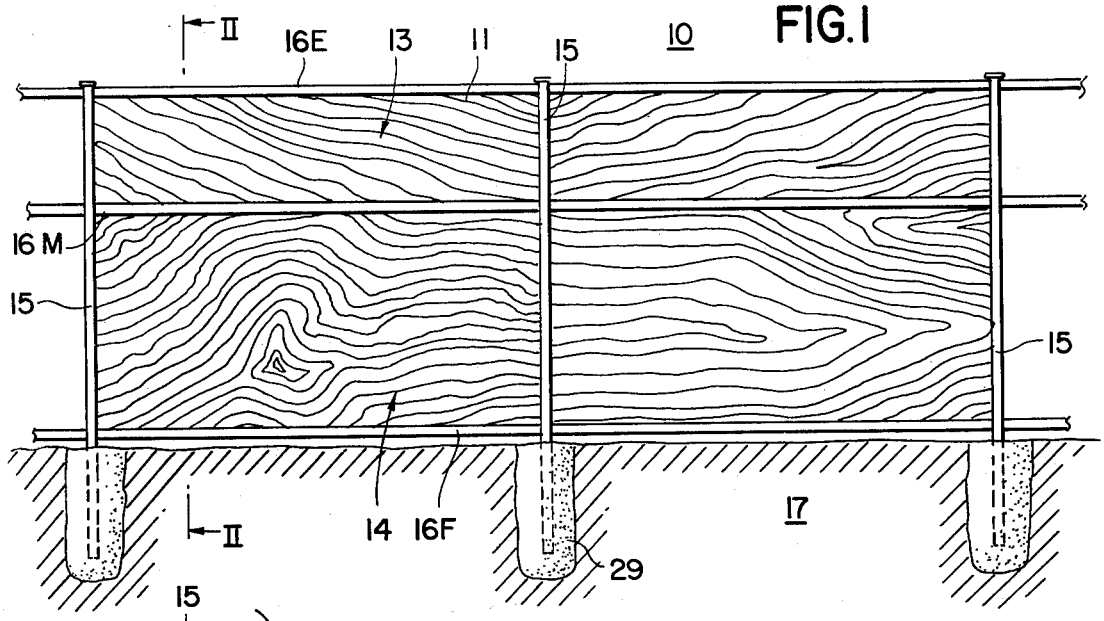
FIG. 1 is an elevation view of the invention in use.
Figure 2:
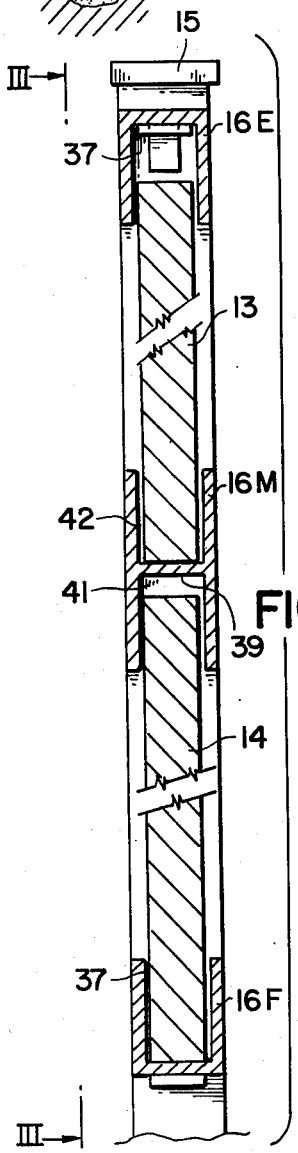
FIG. 2 is a section view of the invention, taken along line 2—2 of FIG. 1.
Figure 3:
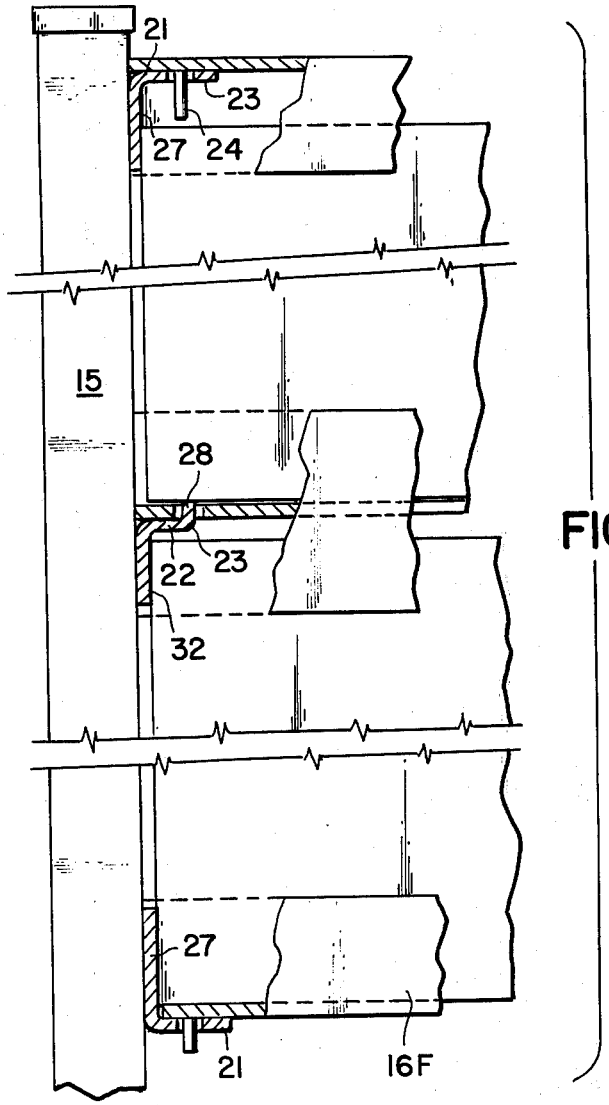
FIG. 3 is a section view of the invention, taken along line 3—3 of FIG. 2.

Turning now descriptively to the drawings, in which similar reference characters denote similar elements throughout the several views, FIGS. 1–3 illustrate the fence 10 which is formed of modular sections 11 of a pair of flat panels 13 and 14 mounted between a pair of vertical support members 15 and between horizontal spacers 16E and 16M, and 16F.

Each vertical member 15 may be staked into the ground 17 and is spaced apart a uniform distance from and adjacent to member 15.

Mounting clips 21 and 22 are fixed to each vertical member 15 for fastening the horizontal spacers 16E and 16M and 16F.

Mounting clips 21 are of an L-shaped section, with one leg 27 fixed to a vertical member 15 and the other leg 23 extending perpendicular to member 15 so as to freely support a horizontal spacer 16E or 16F. A hole 29 in each leg 23 serves to latch a detent 24 that projects from the horizontal spacer 16E and 16F.

Clip 22 is formed of an L-shaped section, fitted at its end with a bent pin flange 28 joined to the horizontal leg 33 of clip 22 with the vertical leg 32 of clip 22 fixed to the vertical member 15 a spaced distance between a pair of mounting clips 21.

A pair of spaced horizontal spacers 16E and 16F each of a U-shaped section, each fit over and latch to a clip 21 on two spaced vertical members, with the spacers 16E and 16F inverted with respect to each other so that the recesses 37 of the spacers 16E and 16F face each other. Preferably clips 21 on a vertical member 15 are inverted with respect to each other so that the horizontal leg 23 of lower clip 21 lies below an attached horizontal spacer 16F and supports said spacer, while horizontal leg 23 of the upper clip 21 lies inside of recess 37 of the upper spacer 16E.

Horizontal spacer 16M is mounted a spaced distance between spacers 16E and 16F, with the mid-section 39 resting at each end of a clip 22 fixed to a vertical member 15, with clip 22 of a width to fit in the lower recess 41 of spacer 16M, and with upper recess 42 of spacer 16M facing inverted recess 37 of upper spacer 16E and lower recess 41 facing recess 37 of 16F, and with flange 28 fitting into hole 29A in mid-section 39.

Recesses 37 of spacers 16E and 16F and recesses 41 and 42 of spacer 16M are of uniform width of a size to fit about and retain panels 13 and 14, when assembled.

In installation, each vertical member 15 is installed as a spaced fence post. Lower spacer 16F is fastened to a pair of adjacent posts 15, panel 14 inserted into recess 37 of spacer 16F, spacer 16M installed to the posts 15 and panel 14, panel 13 fitted into spacer 16F, and spacer 16E installed about clips 22 and panel 13.

For irregular grades, the clips 21 and 22 may be mounted on opposed sides of a post 15 at different heights so that the panels attached to the opposed sides of a given post will be at different heights. Alternately, two posts 15 may be installed in a common post hole 29 and offset at different heights to compensate for irregularities of shape or grade.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A fence kit which may be assembled in modular form from standard units of a plurality of fence posts, each adaptable for staking into ground, a plurality of flat panels and a plurality of U-shaped support spacers said fence posts each fitted with spaced clip means to each detachably support an end section of each of a pair of spacers in spaced array so that the spacers lie in spaced horizontal array when installed, with each pair of spacers enclosing and supporting the opposed horizontal edges of a flat panel, when each spacer is mounted to a pair of said fence posts by said clip means, and when said fence posts are oriented in spaced vertical array, with each said clip means including an angle member fastened to a fence post so that a projecting section of the angle member extends radially from the axis of the attached post, said projecting section being of a size and shape to freely support a spacer end section resting on the said angle member projecting section, in the erect position of the fence post, with the projecting section extending along an axis substantially parallel to the axis of the supported spacer, so that the attached spacers extend between attached fence posts in the plane of the axes of a pair of installed posts, said angle member projecting section and each said end section of the spacer fitted with cooperating detent and hole fastening means located so that in the installed position, the axis of the detent means is parallel to the axis of the post and the cooperating detent and hole fastening means are located to permit the spacer and the projecting section of the angle member to be freely separated by movement of the spacer along a direction that is both substantially parallel to the axis of the fence post and in the direction away from the bottom end of the fence post.

2. The combination as recited in claim 1 in which the assembly includes a plurality of H-shaped spacers, together with bracket means fitted on the fence posts for detachably fastening each H-shaped spacer in spaced array between a pair of spaced U-shaped spacers.

3. The combination as recited in claim 1 in which the cooperating detent and hole means comprise a detent fixed to the end section of the spacer member and a hole formed in the projecting section of the angle member of the clip means, said detent of a size to freely fit into the said hole.

4. The combination as recited in claim 1 in which the cooperating detent and hole means comprise a detent fixed to the projecting section of the angle member and a hole formed in the end section of the spacer member, said detent of a size to freely fit into the said hole.

* * * * *